US005849159A

United States Patent [19]

Heinzmann et al.

[11] Patent Number: 5,849,159

[45] Date of Patent: Dec. 15, 1998

[54] MULTI-LAYER HEADBOX WITH PLASTIC AND METAL DIVIDER PLATE

[75] Inventors: Helmut Heinzmann, Böhmenkirsch; Wolfgang Ruf; Ulrich Begemann, both of Heidenheim; Thomas Dietz, Königsbronn; Frank Fey, Schwäbisch Gmünd, all of Germany

[73] Assignee: Voith Sulzer Papiermaschinen GmbH, Heidenheim, Germany

[21] Appl. No.: 801,132

[22] Filed: Feb. 27, 1997

Related U.S. Application Data

[63] Continuation of Ser. No. 431,345, Apr. 28, 1995, abandoned.

[30] Foreign Application Priority Data

Apr. 29, 1994 [DE] Germany ..... 44 15 053.9

[51] Int. Cl.[6] ..... D21F 1/02

[52] U.S. Cl. ..... 162/343; 162/258; 162/259; 162/347

[58] Field of Search ..... 162/336, 343, 162/347, 258, 259

[56] References Cited

U.S. PATENT DOCUMENTS

| | | | |
|---|---|---|---|
| 4,181,568 | 1/1980 | Pfaler | 162/343 |
| 4,221,635 | 9/1980 | Kurtz et al. | 162/343 |
| 4,349,414 | 9/1982 | Stenberg | 162/123 |
| 4,361,467 | 11/1982 | Bubik et al. | 162/336 |
| 4,381,219 | 4/1983 | Bubik et al. | 162/299 |
| 4,566,945 | 1/1986 | Ewald et al. | 162/343 |
| 4,604,164 | 8/1986 | Fujiwara et al. | 162/343 |
| 4,824,524 | 4/1989 | Hildebrand | 162/343 |
| 5,013,406 | 5/1991 | Hergert | 162/343 |
| 5,030,326 | 7/1991 | Novs | 162/343 |
| 5,431,785 | 7/1995 | Bubik et al. | 162/347 |
| 5,645,689 | 7/1997 | Ruf et al. | 162/343 |

FOREIGN PATENT DOCUMENTS

| | | | |
|---|---|---|---|
| 462472 | 12/1991 | European Pat. Off. | 162/259 |
| 3126460 | 2/1982 | Germany . | |
| 3101407 | 4/1985 | Germany . | |
| 2824608 | 7/1986 | Germany . | |
| 2916351 | 2/1987 | Germany . | |
| 3704462 | 8/1988 | Germany . | |
| 4225297 | 2/1994 | Germany . | |
| 4323050 | 2/1995 | Germany . | |

OTHER PUBLICATIONS

Dubbel, Taschenbuch fur den Maschinenbau, 17 Auflange, Spring, Berlin–Heidelberg–New York, 1990, pp. E82 and E–113–E–116.

*Primary Examiner*—Karen M. Hastings

*Attorney, Agent, or Firm*—Ostrolenk, Faber, Gerb & Soffen, LLP

[57] ABSTRACT

A multi-layer headbox for the production of a multi-layer web of paper has, for instance, three flow planes (I, II, III), each having a pulp feed device (1.1, 1.2, 1.3). In each flow plane a turbulence generator (3) is provided which opens into a nozzle (4). In it there are two plates (5.1, 5.2) which keep two neighboring streams of slurry separate from each other up to the region of the exit slot (8). Each plate is developed as a flexurally soft plate of plastic, the downstream end of which is metal and has a thickness S of at most 0.3 mm. The plastic and metal have a different in coefficients of thermal expansion of $<10^{-7}$1/K.

22 Claims, 2 Drawing Sheets

MULTI-LAYER HEADBOX WITH PLASTIC AND METAL DIVIDER PLATE

This is a Continuation of application Ser. No. 08/431,345 filed on Apr. 28, 1995, now abandoned.

BACKGROUND OF THE INVENTION

The present invention relates to a multi-layer headbox as part of a machine for producing a multi-layer fiber web, particularly a paper web.

Reference is had to:

(1) Federal Republic of Germany OS 37 04 462, (2) Federal Republic of Germany 31 01 407 A1, (3) Federal Republic of Germany 43 23 050 A1, (4) Federal Republic of Germany 29 16 351 C2.

A multi-layer headbox serves for the production of a multi-layer paper web with independent feeding of slurry to the individual nozzle compartments. A plate is arranged between two adjacent nozzle compartments in order to avoid premature mixing of the different slurries until they are brought together outside the nozzle compartment.

Reference (1) discloses a plate in the form of a rigid partition wall which is provided on its upstream end with a swivel shaft on which a regulating device acts. This known construction is intended to make it possible for streams of pulp to be fed to the individual nozzle compartments with speeds and pressures which are independent of each other. Furthermore, the outlet slots of the individual nozzle chambers are to be adjustable independently of each other.

Differing from this, FIG. 7 of the patent of Reference (2) shows a multi-layer headbox, the plates of which are flexible so that the pressures and velocities of flow in adjacent nozzle chambers are equated to each other. The plates of this known headbox are sheet-like, namely relatively thin (aside from a few elevations fastened on the sheets). One problem, however, is that such thin plates tend to flutter and thus produce undesired eddies or turbulences. This is particularly true at the increased operating speeds which are generally required and thus relatively high velocities of flow in the headbox.

As already mentioned, the object of the plates is to separate adjacent streams of pulp in a multi-layer headbox so that no mixing of the different streams takes place until the streams are finally combined in an as undisturbed manner as possible in a single stream, while at the same time, as far as possible, no disturbances take place in the course of this flow, for instance due to fluttering of the plate or plates. Particular attention is also to be paid to the end of the plates, since this region very frequently also forms the starting point of disturbances in flow. In order to avoid these disturbances in the flow, various measures have been undertaken. Among other things, it is proposed in the patent application of Reference (3) that the plates be shaped in such a manner as to produce increased convergence in the outlet region of the nozzle, in order in this way to obtain in this region a reduction in the disturbances due to turbulences by the increase in the velocity of flow. In general, there is the problem that the end of the blade should be pointed (i.e. be as sharp as possible), but for reasons of manufacturing technique, cost, and reliability in operation this cannot always be obtained. This has the result that, finally, as from a given thickness of the end, turbulences or the periodic production of turbulences can take place and, subsequently, oscillations can then be imparted to the end of the plate or the entire plate. In this way, disturbances in the formation of the web and in the covering of the individual layers takes place.

Another patent, Reference (4), proposes solving this problem in the manner that capillaries which introduce air into the flow of pulp terminate at the end of the plate, thus leading to a reduction in the turbulence. This construction is extremely expensive since a correspondingly large number of small capillaries must be drilled in the plates, which means an extreme expense for construction and production.

SUMMARY OF THE INVENTION

The object of the present invention is to propose a solution for a multi-layer headbox which makes it possible to produce a multi-layer fiber web in such a manner that, with the smallest possible thickness of at least one outer layer, a sufficiently uniform covering is obtained, the fiber web having a sufficiently uniform cross section with respect to basis weight, fiber orientation, and composition, and a reasonable compromise with respect to the cost of manufacture.

The inventors have recognized that the following problems arise upon the production of a paper web, the combined solution of which is indicated below:

Eddies are formed at the ends of the plates in a multilayer headbox (due to the finite thickness of the end of the plate), they leading to an undesired mixing of the individual layers. This mixing is particularly disadvantageous if a high-quality paper which has at least one outer side in the form of a thin cover layer of high quality and a support or filling layer of poorer quality (for instance waste paper) is to be produced with the use of a multi-layer headbox. For this reason, it is attempted at the present time to make the end of a plate as thin as possible in order to avoid eddying. This leads, on the one hand, to very high manufacturing costs while, on the other hand, it must be feared that such thin plate ends are not sufficiently stiff and thus are incited into oscillations. As a result, stripe-like patterns are produced in the paper, which are particularly evident when the cover layer is of a different color than the support layer.

It has now been found that the correct method resides in effecting a reasonable compromise. In accordance with the invention the base body (or main part) of the plate is, on the one hand, developed as a flexurally soft plate so that it does not tend to flutter and nevertheless can arrange itself freely between the two streams of pulp. In accordance with a preferred embodiment of the invention, the plate is supported on its upstream end for free swinging around a shaft (extending transverse to the machine). In this case also, it can adjust its position freely between the two streams of pulp. In this way, any differences in pressure which occur between the two adjacent streams of pulp can be compensated for so that the speeds of the two streams of pulp are also equal, as far as possible. From this it results in advantageous manner that eddying, which is caused by a difference in speed between the two streams of pulp, is avoided. On the other hand, in both solutions, the thickness S of the end of the plate is so selected as to avoid as far as possible the eddying which is caused by the finite end thickness S, without having to tolerate the disadvantages of a blade end which tends to oscillate.

The advantageous effect of the last-mentioned measure is based presumably on the fact that either a periodic production of eddying no longer occurs at all, or that the eddying frequency f which is established (which is a function of the end thickness S and of the velocity of flow V) is, for the velocities of flow typical in the headbox, within a range outside the excitation frequency of the end of the plate. In any event, it is possible, as a result of the invention, to produce a multi-layer jet of pulp which is completely, or practically completely, free of disturbances.

Up to now, in the known headboxes, a locally deformable strip or baffle has been arranged on one of the nozzle lips in order to compensate for differences with respect to the basis weight or the orientation of the fiber. This technique proves particularly disadvantageous when importance is placed on a cover layer which is as thin as possible but is nevertheless to provide a very uniform masking of the underlying layer. If, namely, the baffle of the headbox is displaced, then the jet is deformed, the thickness of the outer layer being primarily affected although it should actually remain of the same thickness.

An additional problem arises with a baffle at the nozzle end of the headbox due to the fact that a displacement of the baffle changes the geometry of the nozzle end, resulting in a non-uniform fanning out of the jet of pulp depending on the location, which in its turn leads to different degrees of mixing of the layers and also to an undesired influencing of the orientation of the fiber.

In addition to the above-mentioned disadvantages of the baffle at the nozzle end, a baffle-adjustment device also means that the nozzle of the headbox cannot be brought sufficiently close to the wire, particularly when used together with twin-wire formers, thus resulting in an undesirably long unguided jet of pulp, which makes itself felt by a reduction in quality, in particular, in the case of multi-layer papers.

For these reasons, it is proposed that a deformable baffle or a baffle adjustment be completely dispensed with and that, instead of it, corrections of the transverse profile of the basis weight be obtained by a local change in the concentration of the pulp slurry (i.e. by sectional control of the feeding of the slurry).

By this measure, the advantage is obtained that the nozzle end of the headbox is of very simple shape, and thus also requires little expense from the standpoint of manufacturing technique, and, due to the elimination of the adjustment devices, can also be brought very close to the wire or between the wires, as a result of which, in turn, the advantage is obtained of a much shorter free jet of pulp. Furthermore, there is thus also a possibility of optimizing the end region of the nozzle with respect to the flow, without having to take into account possibilities of adjustment of the baffle.

Together with the measures described above, this leads to a substantially simplified construction of the headbox, with the resultant cost advantage with respect to manufacture and maintenance, while at the same time increasing the quality of the paper.

The flexurally soft plate proposed in accordance with the invention can be firmly fastened at its upstream end to a structural part of the headbox. However, it is preferred that the flexurally soft plate also be suspended in freely movable manner on an upstream shaft lying transverse to the direction of flow. By this slurry, assurance is had that, as a result of the equalization of pressure which takes place, the velocities of flow of the individual layers can be better equated to each other, as a result of which—after the coming together of adjacent layers—the undesired eddying at the boundaries is at least substantially avoided.

In this way, the shearing forces between the layers are minimized and the covering of the layers in the finished paper is optimized. The cooperation with the sectioned control of the flow of the slurry is particularly advantageous, since here, with all adjustments of the individual streams of slurry, identical velocities of the individual layers are always present, without the necessity of any further action.

The plate is preferably made of a plastic.

Furthermore, it is possible for the plate to be formed of a plastic base body and a metallic end of the plate, the difference in the coefficients of thermal expansion being $<10^{-7}$1/K. In this connection, it is advantageous that no stresses and bends occur at different temperatures in the plate, particularly in the end region of the plate, which would result in a non-uniform cross section of the layer thickness.

Summarizing, it is to be noted that a new concept is proposed for a multi-layer headbox which, by the use of the knowledge set forth above and its combined application, leads to a headbox which satisfies the requirements of modern paper technology and at the same time can be manufactured at a reasonable cost. This is possible due to the fact that as a result of the cooperative action of the individual components of the headbox, one can intentionally dispense with exaggerated demands as to individual elements and, on the other hand, achieve the desired goal, by a suitable selection of the correct requirements as to the components, namely the production of a high-grade multi-layer paper.

BRIEF DESCRIPTION OF THE DRAWINGS

The invention will be described in further detail with reference to the drawings, in which.

DETAILED DESCRIPTION

Figure 1:
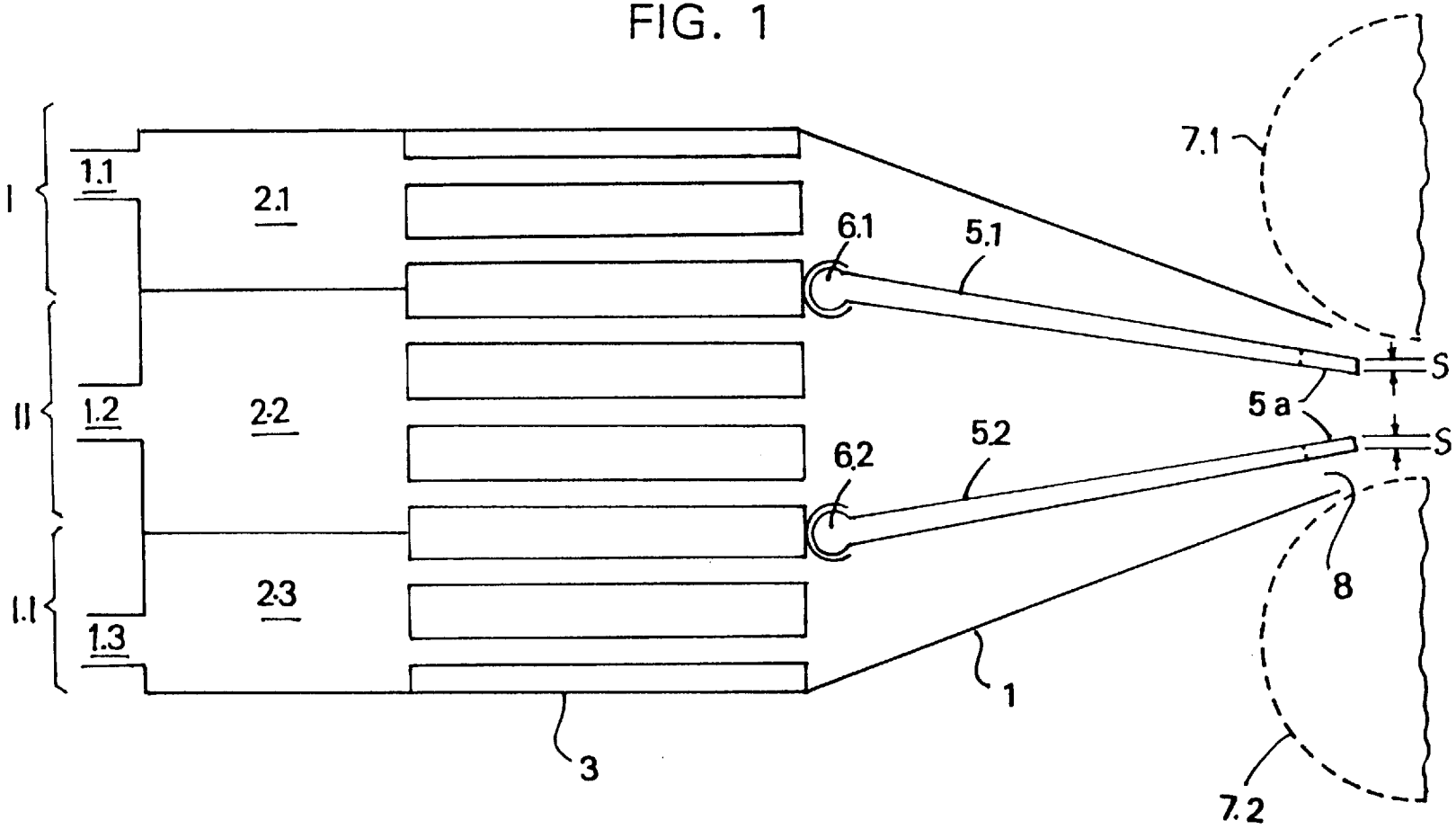
FIG. 1 is a cross section through a three-layer headbox in accordance with the invention.

FIG. 1 shows a three-layer headbox in accordance with the invention having feeds 1.1, 1.2, and 1.3 to the individual flow planes I, II, and III. The feeds may optionally be fed by a cross distributor or by a plurality of individually adjustable streams of pulp. A particularly economical development is present if the middle layer II is supplied in concentration-controlled manner with the help of a plurality of mixing devices (similar to FIG. 2), whereby the basis weight can be adjusted in simple manner.

The pulp streams then pass into separate pre-chambers 2.1, 2.2, and 2.3, from where they pass into the turbulence producing section 3 which produces here a microturbulence by the wall-friction action of a plurality of channels.

Adjoining section 3, the individual streams of slurry pass, separated from each other by plates 5.1 and 5.2, into the nozzle 4 of the headbox. The plates are swiveled, free of momentum, to machine-wide shafts 6.1 and 6.2 and thus arrange themselves freely in accordance with the conditions of flow, as described above.

The plates consist either entirely of plastic or of two materials, namely plastic for the base body and metal for the downstream end 5*a* of the plates. In one possible embodiment, a flexurally soft plate which, however, does not tend to flutter in the flow is used. The plastic preferably has a modulus of elasticity of <80,000 N/mm$^3$ and the thickness of the plate is approximately on the order of between 3 and 12 mm. In accordance with the invention, the end of the plate has a thickness S of at most 0.3, and preferably at most 0.1 to 0.2 mm. From the drawing, which is very diagrammatic here, it can also be noted that, due to the elimination of a baffle displacement, the headbox nozzle comes very close between the wire guide rolls 7.1, 7.2, shown in dotted line, so that an extremely short free pulp jet can be obtained.

Figure 2:
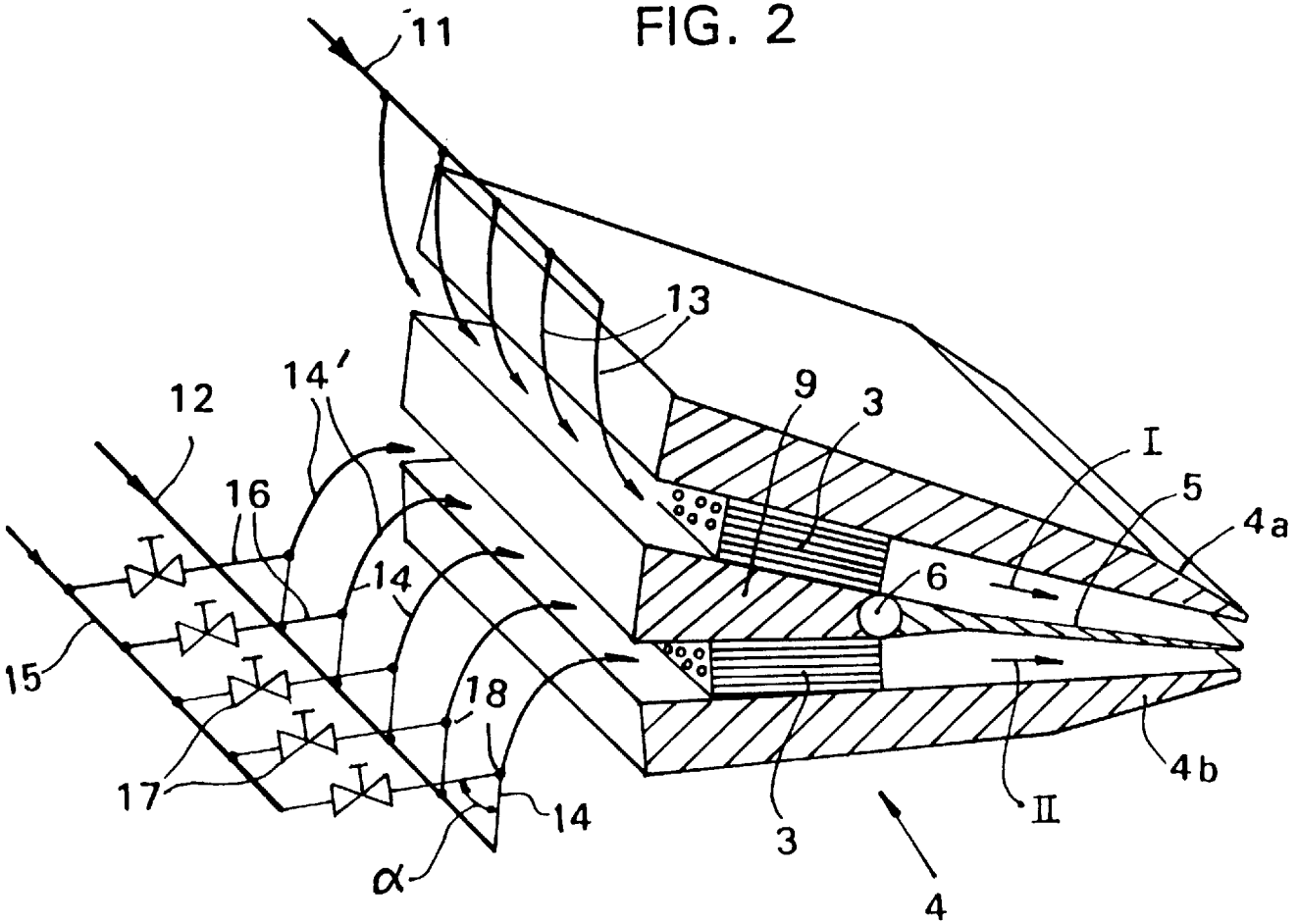
FIG. 2 is an oblique view of a two-layer headbox with pulp feed lines indicated diagrammatically.

FIG. 2 shows a two-layer headbox together with a diagrammatically shown system of lines for the feeding of different fiber slurries. The nozzle 4 is limited in known manner by two machine-wide flow guide walls 4*a* and 4*b*. They are connected in each case via a known turbulence generator 3 to a middle, stationary partition wall 9. A plate 5 is fastened again swingably, by means of a joint 6, on the outlet end of the partition wall 9. Differing from this, the plate 5 can also be rigidly fastened on the partition wall 9. A first main stream of pulp, consisting of a first type of paper pulp, passes, via a cross-distributor line 11 and a series of sectional feed lines 13 branching off therefrom, to one of the two turbulence generators 3. Differing from FIG. 2, a volumetric flow regulator can be provided in each of the sectional feed lines 13. A second main pulp stream, consisting of a different type of pulp, passes, via a cross-distributor line 12 and a series of sectional feed lines 14, 14' branching off therefrom, to the other turbulence generator 3. In order that the basis-weight cross section of the paper web to be produced can be corrected if necessary, a third cross-distributor line 15 is provided for feeding a so-called secondary pulp stream. It consists, for instance, of dilution water or of the second type of pulp, but with a different, and preferably smaller, pulp density. Several sectional feed lines 16, each having a control valve 17, branch off from the cross-distributor line 15. Each of the lines 16 thus conducts a controllable sectional secondary stream of pulp to a mixing place 18, where it is mixed with one of the sectional main pulp streams. In the case of a three-layer headbox, the system of conduits 12–17 will be associated with the mixing places 18 preferably of the middle layer. Differing from FIG. 2, the following could furthermore be provided: Further feed lines for individually controllable sectional secondary pulp streams could merge into the sectional feed lines 13 for the first main pulp stream.

Although the present invention has been described in relation to particular embodiments thereof, many other variations and modifications and other uses will become apparent to those skilled in the art. Therefore, the present invention should be limited not by the specific disclosure herein, but only by the appended claims.

We claim:

1. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry.

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

at least one plate in the nozzle that keeps two adjacent streams of slurry separate from each other up to a region of the exit slot;

the plate comprising a flexible plate extending from a region near the sections for producing microturbulence to a region of the exit slot, the plate having a base body of plastic and a downstream end of metal, the plastic and metal having a difference in coefficients of thermal expansion of $<10^{-7}1/K$; and the downstream end of the plate having a thickness S of at most 0.1 mm to 0.3 mm.

2. The headbox according to claim 1, wherein each plate is mounted on an upstream end freely movably around a shaft which extends over the machine width transverse to the direction of flow.

3. The headbox according to claim 1, wherein the downstream end of the plate has a thickness S of at most 0.1 to 0.2 mm.

4. The headbox according to claim 1, wherein at least one of the sections for producing microturbulence comprises a plurality of channels extending in the direction of flow distributed over the machine width.

5. The headbox according to claim 1, wherein the region of the slot is free of baffle adjustment devices, and further comprising a sectioned pulp density control in at least one flow plane.

6. The headbox according to claim 5, further comprising means for controlling density of the pulp fed to at least one of the flow planes comprising:

a plurality of pulp slurry feed lines for at least one flow plane distributed over the machine width;

a mixer providing in each pulp slurry feed line, each mixture comprising:

at least two inlets and an outlet;

at least one of the inlets of each mixer having means for regulating the flow; and individual feeds to each mixer having different properties.

7. The headbox according to claim 6, further comprising a plurality of pulp slurry feed lines, distributed over the machine width feeding at least one flow plane which is free of pulp density control.

8. The headbox according to claim 1, wherein the modulus of elasticity of the plastic is less than 80,000 $N/mm_2$.

9. The headbox according to claim 1, wherein the multilayer fiber web comprises a multilayer paper web.

10. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry;

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

at least one plate in the nozzle that keeps two adjacent streams of slurry separate from each other up to a region of the exit slot;

the plate being mounted for free movement at an upstream end around a shaft which extends over the machine width transverse to a direction of flow of the fiber slurry, the plate having a base body of plastic and a downstream end of metal, the elastic and metal having a difference in coefficients of thermal expansion of $<10^{-7}1/K$; and the downstream end of the plate having a thickness S of at most 0.1 mm to 0.3 mm.

11. The headbox according to claim 10, wherein each plate comprises a flexible plate from a region of the sections for producing microturbulence to the region-of the exit slot.

12. The headbox according to claim 10, wherein the downstream end of the plate has a thickness S of at most 0.1 to 0.2 mm.

13. The headbox according to claim 10, wherein at least one of the sections for producing microturbulence comprises a plurality of channels extending in the direction of flow distributed over the machine width.

14. The headbox according to claim 10, wherein the region of the slot is free of baffle adjustment devices, and further comprising a sectioned pulp density control in at least one flow plane.

15. The headbox according to claim 14, further comprising means for controlling density of the pulp fed to at least one of the flow planes comprising:

a plurality of pulp slurry feed lines for at least one flow plane distributed over the machine width;

a mixer providing in each pulp slurry feed line, each mixture comprising:

at least two inlets and an outlet;

at least one of the inlets of each mixer having means for regulating the flow; and individual feeds to each mixer having different properties.

16. The headbox according to claim 15, further comprising a plurality of pulp slurry feed lines, distributed over the machine width feeding at least one flow plane which is free of pulp density control.

17. The headbox according to claim 10, wherein the modulus of elasticity of the plastic is less than 80,000 $N/mm^2$.

18. The headbox according to claim 10, wherein the multilayer fiber web comprises multilayer paper web.

19. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry;

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

at least one plate in the nozzle that keeps two adjacent streams of slurry separate from each other up to a region of the exit slot;

the plate comprising a flexible plate extending from a region near the sections for producing microturbulence to a region of the exit slot, the plate being flexible to equalize pressures of the slurry streams on either side of the plate thereby to minimize eddy currents in the slurry streams at a downstream end of the plate and reduce oscillation of the plate, the plate having a base body of plastic and the downstream end of metal, the plastic and metal having a difference in coefficients of thermal expansion of $<10^{-7}1/K$; and the downstream end of the plate having a thickness S of at most 0.1 mm to 0.3 mm and being selected to minimize oscillation of the plate.

20. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry;

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

at least one plate in the nozzle that keeps two adjacent streams of slurry separate from each other up to a region of the exit slot;

the plate being mounted for free movement at an upstream end around a shaft which extends over the machine width transverse to a direction of flow of the fiber slurry, the plate being mounted for free movement to equalize pressures of the slurry streams on either side of the plate thereby to minimize eddy currents in the slurry streams at a downstream end of the plate and reduce oscillation of the plate, the plate having a base body of plastic and the downstream end of metal, the plastic and metal having a difference in coefficients of thermal expansion of $<10^{-7}1/K$; and the downstream end of the plate having a thickness S of at most 0.1 mm to 0.3 mm and being selected to minimize oscillation of the plate.

21. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry;

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

at least one plate in the nozzle that keeps two adjacent streams of slurry separate from each other up to a region of the exit slot;

the plate comprising a flexible plate extending from a region near the sections for producing microturbulence to a region of the exit slot, the plate having a base body of plastic and a downstream end of metal, the plastic and metal having a difference in coefficients of thermal expansion of $<10^{-7}1/K$; and the downstream end of the plate having a thickness S of at most 0.1 mm to about 0.2 mm.

22. A multi-layer headbox forming a part of a machine for the production of a multi-layer fiber web, the machine having a machine width for producing a web of the machine width, the headbox comprising:

at least two flow regions defining flow planes each conducting a fiber slurry, each flow plane having at least one feed device for the fiber slurry;

a section in each flow plane for producing microturbulence in the fiber slurry;

a nozzle coupled downstream to the sections for producing microturbulence;

each section for producing microturbulence opening into the nozzle, the nozzle having an exit slot having a width comprising the machine width;

a baffle disposed in the nozzle and adapted to operatively engage the fiber web but not compensate for a basis weight of the fiber web;

at least one plate in the nozzle that keeps two adjacent streams of slurry separate from each other up to a region of the exit slot;

the plate comprising a flexible plate extending from a region near the sections for producing microturbulence to a region of the exit slot, the plate having a base body of plastic and a downstream end of metal, the plastic and metal having a difference in coefficients of thermal expansion of $<10^{-7}1/K$;

the downstream end of the plate having a thickness S of at most about 0.1 mm to 0.3 mm;

the headbox further comprising means for controlling density of the pulp fed to at least one of the flow planes comprising:

a plurality of pulp slurry feed lines for at least one flow plane distributed over the machine width;

a mixer provided in each pulp slurry feed line, each mixer comprising:

at least two inlets and an outlet;

at least one of the inlets of each mixer having means for regulating the flow; and individual feeds to each mixer having different properties.

* * * * *